United States Patent [19]

Trost

[11] 4,228,827

[45] Oct. 21, 1980

[54] HEDDLE FOR A WEAVING MACHINE FOR MAKING TRIAXIAL FABRICS

[75] Inventor: Wayne C. Trost, Rockford, Ill.

[73] Assignee: Barber-Colman Company, Rockford, Ill.

[21] Appl. No.: 7,760

[22] Filed: Jan. 30, 1979

[51] Int. Cl.[2] ..... D03C 13/00

[52] U.S. Cl. ..... 139/93; 139/DIG. 1

[58] Field of Search ..... 139/DIG. 1, 93, 94, 139/95, 96

[56] References Cited

U.S. PATENT DOCUMENTS

| | | | |
|---|---|---|---|
| 3,548,885 | 12/1970 | Wagner | 139/96 |
| 3,985,160 | 10/1976 | Kulczycki et al. | 139/93 |

*Primary Examiner*—Henry Jaudon

*Attorney, Agent, or Firm*—Robert M. Hammes, Jr.

[57] ABSTRACT

A heddle for a weaving machine for making triaxial fabrics has a nose portion with a rounded free end of substantially the same thickness as a major portion of the heddle. The nose postion is also provided with a warp strand guide opening therethrough and reduced thickness portions between the opening and the edges of the nose portion to minimize warp strand abrasion during weaving.

12 Claims, 9 Drawing Figures

HEDDLE SHIFTING MEANS
SHED FORMING MEANS
PRIOR ART
TO FELL OF CLOTH

HEDDLE FOR A WEAVING MACHINE FOR MAKING TRIAXIAL FABRICS

BACKGROUND OF THE INVENTION

This invention relates to triaxial weaving machines of the type disclosed in U.S. Pat. No. 3,999,578 of common ownership with the instant application. More specifically, the invention relates to improvements over the heddle inventions disclosed in U.S. Pat. Nos. 3,965,939; 3,985,160; and 4,040,451, all of common ownership with the instant application.

Prior art heddles for triaxial weaving machines which are presently in use are typically made of an elongate strip material and have a rounded nose portion provided with a warp strand guide opening therethrough. The nose portions are typically of lesser thickness than at least the major portion of the heddle and are partially offset on respective sides of the warp strand guide opening to avoid abrading a warp strand passing alongside the nose portion and through the guide opening during weaving and to maintain the warp strands substantially within the thickness dimension of the major portion of their respective heddles. Heretofore it has been necessary to provide nose portions which are reduced in thickness so that this offset can be provided without the offset portions extending beyond the sides of the heddle so as to reduce the likelihood of interference of opposing heddles during shedding.

Several problems have been encountered in using heddles of this type. In certain instances when misalignments occur the thin nose portion has caused abrading or piercing of warp strands carried by heddles in an opposing row during shedding operations. Also, the thin nose portions are susceptible to damage in the event of collision with opposing heddles during shedding. In addition, while the offset portions reduce warp strand abrasion due to movement of the warp strands through the guide opening the configuration of the opening and offset portions still caused abrasion of warp strands as the heddles move back and forth during shedding.

In any weaving operation it is important to minimize damage to the warp strands so that a quality fabric can be produced. It is also important to avoid downtime due to damaged heddles which necessarily reduces the overall efficiency of the weaving operation. In this connection it is apparent that the design of the heddle and, particularly, the warp strand guide opening is critical.

SUMMARY OF THE INVENTION

The heddle of the present invention is provided with a nose portion having a free end of thickness substantially the same as at least the major portion of the frontal portion of the heddle, the free end preferably being rounded from side-to-side as well as from edge-to-edge. The nose portion also has a warp strand guide opening extending therethrough which preferably has smoothly contoured surfaces associated therewith to minimize warp strand abrasion during the weaving operations, including heddle transfer and heddle shedding operations. The contoured surfaces may comprise reduced thickness portions between the guide opening and respective edges of the nose portion of the heddle.

The provision of a heddle not having a reduced thickness nose portion minimizes damage to opposing warp strands during shedding and damage to the heddles themselves which may otherwise result due to heddle collisions.

A more thorough understanding of the invention will be obtained from the following detailed description taken in conjunction with the drawing figures.

BRIEF DESCRIPTION OF THE DRAWINGS

Referring to the drawing figures, the improved heddle, generally indicated at 10, is particularly devised for use in a triaxial weaving machine. As shown in FIG. 2, a typical triaxial weaving machine may include a warp shed forming means 11 for moving a weftwise row of heddles longitudinally during warp shed forming operations, and a heddle shifting means 12 for shifting the heddles weftwise of the weaving machine. For the purposes of this disclosure only a few heddles 10 of a single weftwise row are shown in FIG. 2. These heddles are typically arranged to cooperate with a similar opposing row of heddles, not shown, for forming warp sheds of the warp strands Y extending through the heddles to the fell of the fabric being woven. The weaving machine may be provided with a single row of heddles on each side of the machine, or multiple rows on each side of the machine. For instance, FIG. 3 shows two weftwise rows of heddles 10 superimposed one above the other on one side of a triaxial weaving mechine.

Figures 1, 2, 3, 4, 5, 6, 7, 8, 9:
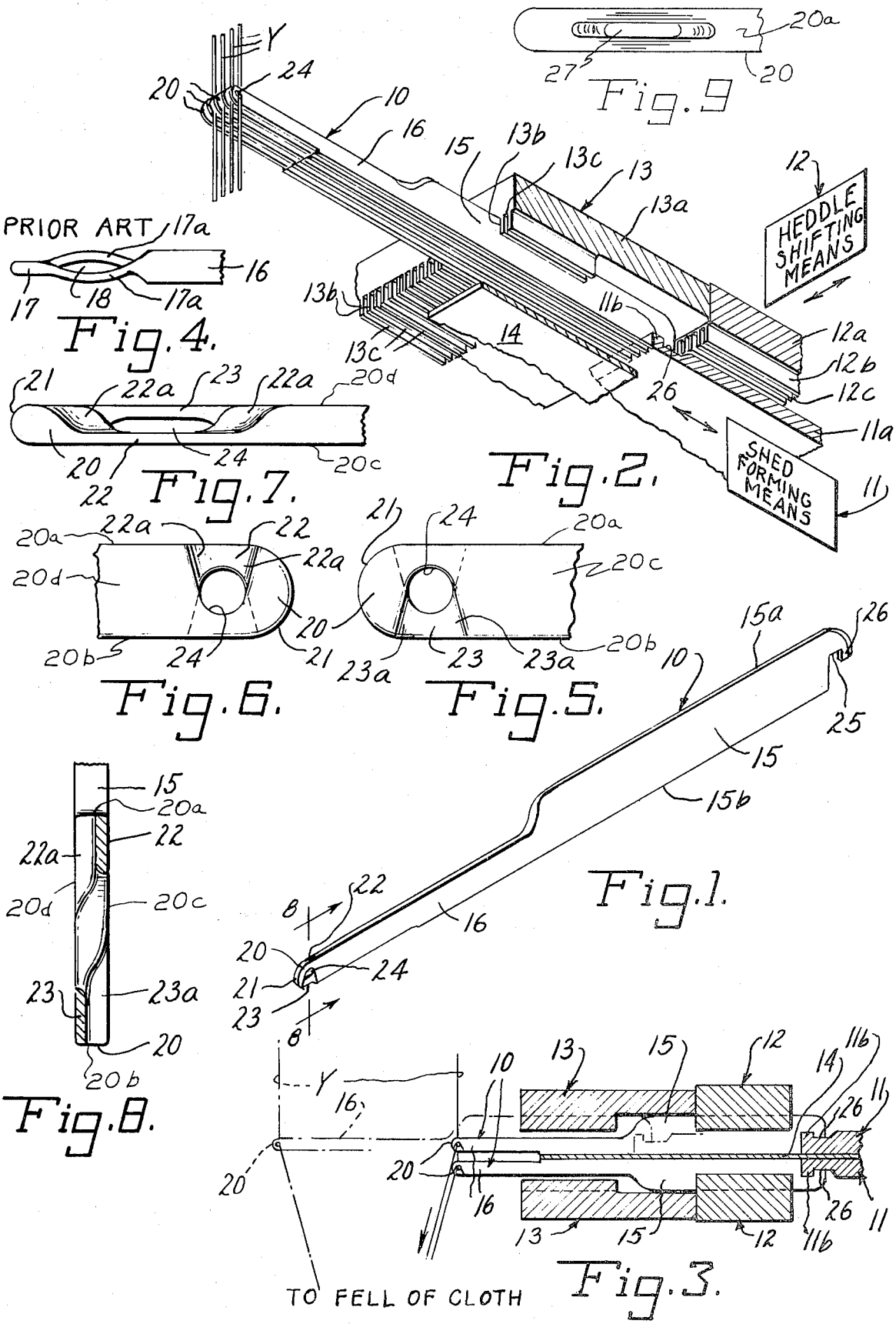
FIG. 1 is a perspective view of a preferred embodiment of a heddle according to the invention.
FIG. 2 is a schematic perspective view of a series of adjacent heddles as arranged in a weftwise row in a triaxial weaving machine.
FIG. 3 is a fragmentary vertical sectional end view of two weftwise rows of heddles and associated heddle shedding and heddle shifting apparatus as arranged on one side of a triaxial weaving machine.
FIG. 4 is an enlarged view of the nose portion of a prior art heddle used in a triaxial weaving machine.
FIG. 5 is an enlarged front side view of the nose portion of the heddle shown in FIG. 1.
FIG. 6 is an enlarged back side view of the nose portion of the heddle shown in FIG. 1.
FIG. 7 is an enlarged top view of the f
the heddle shown in FIG. 1
FIG. 8 is an enlarged sectional end view of the heddle shown in FIG. 1 taken along the line 8—8.
FIG. 9 is an enlarged top view of the nose portion of another embodiment of a heddle according to the invention.

The weaving machine is provided with a suitable heddle guide means 13 cooperating with the heddle shifting means 12 for guiding the respective rows of heddles forwardly and rearwardly between a retracted position and an extended position as effected by shed forming means 11. A typical warp shed forming means 11 includes a weftwise extending heddle shedding bar **11*a* which is movable forwardly and rearwardly during shedding operations. Heddle bar 11*a* is provided with an elongate weftwise extending projection or rib 11*b* which is adapted to engage heddles 10**.

Heddle shifting means 12 is shown as comprising an elongated weftwise extending heddle shifting member or bar **12*a* which is movable weftwise. Heddle shifting bar 12*a* is provided with a plurality of teeth or wall members 12*b* spaced apart in the weftwise direction and defining passageways or slots 12*c* for receiving respective heddles therein to facilitate shifting heddles weftwise through weftwise movement of heddle bar 12*a***.

The heddle guide means 13 typically comprises a stationary weftwise extending heddle guide member for bar 13*a* having a plurality of weftwise extending teeth or wall members 13*b* spaced apart to define passageways or slots 13*c* for receiving and guiding respective heddles 10 when heddles 10 are moved longitudinally to the extended position by shed forming means 11.

A guide plate 14 may be located below heddles 10 as shown in FIG. 2 so as to provide a suitable guide surface for heddles 10. In FIG. 3 guide plate 14 is shown between the two superimposed rows of heddles thereby providing a guide surface for the heddles of both rows.

The operation of a typical triaxial weaving machine in which the heddles of the instant invention are useful is more fully described in U.S. Pat. No. 3,999,578 which is hereby incorporated by reference into this description to the extent necessary for full understanding of this invention.

Referring now to FIG. 1, a preferred embodiment of a heddle according to the invention and suitable for use in a triaxial weaving machine is shown. As described more fully in U.S. Pat. No. 3,985,160, which is hereby incorporated by reference into this description to the extent necessary for complete understanding of this invention, the heddle 10, which may be formed from an elongate strip material, comprises an elongated body portion 15 having a predetermined width defined by top edge 15*a* and bottom edge 15*b*, and an elongated reduced width frontal portion 16 extending forwardly from the body portion 15. In prior art heddles, frontal portion 16 terminates in a reduced thickness nose portion 17 as shown in FIG. 4. Nose portion 17 is provided with a warp strand guide opening 18 extending therethrough and is further provided with offset portions 17*a* which are offset on respective sides of the warp strand guide opening to avoid abrading a warp strand passing alongside the nose portion 17 and through opening 18. From an examination of FIG. 4 it will be readily apparent that abrasion of warp strands may still occur when the heddle is moved longitudinally between extended and retracted positions during shed forming.

The preferred embodiment of a heddle according to the invention has an improved nose portion design which provides smooth contoured surfaces to minimize warp strand abrasion. As best seen in FIGS. 1 and 7, the preferred embodiment of heddle 10 is provided with a nose portion 20 having a thickness substantially the same as that of at least the major portion of frontal portion 16. Nose portion 20 terminates in a free end 21 which is preferably rounded both from side 20*c* to side 20*d* and from edge 20*a* to edge 20*b* so as to minimize snagging, piercing or abrading opposing warp strands during shedding. Providing a nose portion 20 of substantially greater thickness than the nose portions of prior art heddles and being rounded from side to side substantially reduces the probability of damage to opposing warp strands since the heddles tend to push such warp strands aside as opposed to snagging or piercing such warp strands. In a similar manner, interferring opposing heddles tend to push each other aside thereby avoiding direct collision. At the same time, this design provides a heddle having greater strength in the nose portion thereby reducing the probability of heddle damage which may result from interference of opposing heddles during shedding.

Nose portion 20 is provided with a warp strand guide opening 24 which may extend through nose portion 20 from front side 20*c* to back side 20*d*. Nose portion 20 may be further provided with upper and lower reduced thickness sections 22, 23 between opening 24 and top edge 20*a* and bottom edge 20*b* respectively. As best seen in FIG. 7, reduced thickness portions 22, 23 are preferably offset on respective opposite sides of opening 24 to avoid abrading a warp strand passing alongside the nose portion and through the warp strand guide opening 24 during weaving. Reduced thickness sections 22, 23 also preferably have respective associated smoothly contoured surfaces 22*a*, 23*a* which blend into backside 20*d* and frontside 20*c*, respectively. As best seen in FIG. 8, surfaces 22*a*, 23*a* may also blend into surface 24*a* defining warp strand guide opening 24. Thus, the contoured surfaces 22*a*, 23*a* provide a smooth surface over which a warp strand may pass without abrasion. Employing offset, reduced width portions 22, 23 permit warp strands to pass alongside nose portion 20 through guide opening 24 while being maintained substantially within the thickness dimension of the major portion of nose portion 20 as defined by sides 20*c*, 20*d*. Thus, as opposing rows of heddles come together in their extended positions during a shedding operation, the likelihood of warp strand abrasion is substantially reduced. The reduced thickness portions 22, 23 and contoured surfaces 22*a*, 23*a* may be formed by coining, swaging or electro-discharge machining and subsequent polishing of edges as may be necessary to obtain suitably smooth, contoured surfaces.

In use, heddles 10 are arranged in weftwise rows in a triaxial weaving machine in cooperation with shed forming means 11, heddle shifting means 12 and heddle guide means 13 as seen in FIGS. 2 and 3. Heddles 10 are provided with a cutout 25 and a hook shaped projection 26 at their rear ends, hook shaped projection 26 being adapted to engage rib 11*b* of heddle shedding bar 11*a* to facilitate longitudinal movement of heddles 10 as effected by shed forming means 11.

As is apparent from FIG. 3, as heddles 10 are moved longitudinally between retracted positions (shown in solid lines) and extended positions (shown in phantom) the warp strands Y running from a warp supply (not shown) through openings 24 of heddles 10 to the fell of the cloth form an angle with respect to the vertical direction. In order to further insure minimal abrasion of the warp strands, reduced thickness sections 22, 23 are preferably flared outwardly in the plane of the heddle 10 from opening 24 to top edge 20*a* and bottom edge 20*b* respectively. The flaring angle is preferably such that it is at least equal to the angle formed by warp strands Y when heddles 10 are in either the extended or retracted positions.

It is thus seen that the improved nose portion design of the instant invention provides a surface over which the warp strands may travel during the weaving operation with minimal abrasion possibilities.

It should also be noted that while warp strand guide opening 24 is shown as extending from side to side through nose portion 20 of heddle 10, providing a nose portion having greater thickness than that of prior art heddles may permit provision of a warp strand guide opening which extends through nose portion 20 from top edge 20*a* to bottom edge 20*b*. A top view of a heddle of this type is shown in FIG. 9 in which warp strand guide opening 27 extends vertically through the heddle. In such case the opening may also be flared from the central portion to the top and bottom edges respectively as shown in FIG. 9.

It is thus seen that the instant invention provides a heddle for a triaxial weaving machine which heddle has an improved nose portion design adapted to minimize warp strand abrasion during the weaving operation as well as minimizing damage to opposing warp strands and the heddles themselves which may occur during shedding operations.

The drawings and description disclose preferred embodiments of heddles according to the invention which should be considered exemplary only. Various modifications and alternate embodiments may be made which come within the scope and spirit of the invention and thus the invention is to be limited solely by the claims.

I claim:

1. An elongate heddle for a weaving machine for making triaxial fabrics wherein the heddle is adapted to be moved longitudinally during a warp shed forming operation and also is adapted to be shifted weftwise of the weaving machine, said heddle being an elongate strip material and comprising a frontal portion terminating in a nose portion comprising a rounded free end and a warp strand guide portion having a warp strand guide opening extending therethrough wherein the improvement comprises said nose portion being of substantially the same thickness as the major portion of said frontal portion and said warp strand guide portion is formed to provide a warp strand path which is at least partially within the thickness dimension of the nose portion.

2. A heddle according to claim 1 wherein said free end is rounded from one side to the other side of said heddle.

3. A heddle according to claim 1 wherein said guide opening extends through said heddle from one side to the other side, said nose portion additionally comprising a first reduced thickness portion between said guide opening and a first edge of said nose portion, said first reduced thickness portion being of lesser thickness than at least the major portion of said frontal portion.

4. A heddle according to claim 3 wherein said first reduced thickness portion is at least partially offset on a side of said opening.

5. A heddle according to claim 3 additionally comprising a second reduced thickness portion between said guide opening and a second edge of said nose portion, said second reduced thickness portion being of lesser thickness than at least the major portion of said frontal portion.

6. A heddle according to claim 5 wherein said second reduced thickness portion is at least partially offset on a side of said opening.

7. A heddle according to claim 6 wherein said first and second reduced thickness portions are offset on respective opposite sides of said opening.

8. A heddle according to claim 3 wherein said first reduced thickness portion flares outwardly in the plane of said nose portion of said opening to said first edge.

9. A heddle according to claim 3 wherein a surface of said first reduced thickness portion is smoothly contoured to blend into a side of said heddle.

10. A heddle according to claim 3 wherein a surface of said first reduced thickness portion is smoothly contoured to blend into the surface defining said guide opening.

11. A heddle according to claim 1 wherein said nose portion comprises first and second edges, said guide opening extending through said heddle from said first edge to said second edge.

12. A heddle according to claim 11 wherein said opening flares outwardly in the plane of said nose portion from the central portion of said nose portion to said first edge.

* * * * *

UNITED STATES PATENT AND TRADEMARK OFFICE

CERTIFICATE OF CORRECTION

PATENT NO. 4,228,827

DATED October 21, 1980

INVENTOR(S) : Wayne C. Trost

It is certified that error appears in the above-identified patent and that said Letters Patent are hereby corrected as shown below:

In column 2, lines 23 and 24 should read --Fig. 7 is an enlarged top view of the nose portion of the heddle shown in Fig. 1--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*